US005387087A

United States Patent [19]

Chen

[11] Patent Number: 5,387,087

[45] Date of Patent: Feb. 7, 1995

[54] FAN CAPABLE OF DIRECTING AIR FLOW IN BOTH AXIAL AND RADIAL DIRECTIONS

[76] Inventor: Li-Mei Chen, Te-Li No. 3-3, Kuang-Hsing Rd., Tai-Ping Hsiang, Taichung Hsien, Taiwan, Prov. of China

[21] Appl. No.: 219,026

[22] Filed: Mar. 28, 1994

[51] Int. Cl.[6] ..... F04D 29/22; F04D 29/30

[52] U.S. Cl. ..... 416/188; 416/179; 416/223 B

[58] Field of Search ..... 416/179, 182, 183, 185, 416/188, 223 B

[56] References Cited

U.S. PATENT DOCUMENTS

| | | | |
|---|---|---|---|
| 1,469,870 | 10/1923 | Allen | 416/182 |
| 1,879,812 | 9/1932 | Miller | 416/179 |
| 2,508,144 | 5/1950 | Carville | 416/183 |
| 3,727,593 | 4/1973 | Enke | 416/188 |
| 4,521,154 | 6/1985 | Corbett | 416/182 |
| 4,670,677 | 6/1987 | Snider et al. | 416/182 |

*Primary Examiner*—Edward K. Look

*Assistant Examiner*—Michael S. Lee

*Attorney, Agent, or Firm*—Reinhart, Boerner, Van Deuren, Norris & Rieselbach

[57] ABSTRACT

A fan is capable of directing air passing between upstream and downstream ends of the fan to flow in both axial and radial directions and includes a hub, a plurality of fan blades and a ring. The hub is shaped as a truncated cone with a wide upstream end and a narrow downstream end. Each of the fan blades has an upstream edge, an outer end and an inner end connected to the hub. The fan blades project radially and outwardly from the hub and are spaced circumferentially. The ring is disposed at the upstream edges of the fan blades and interconnects the outer ends of the latter. The ring is formed with a plurality of curved strips which extend respectively between two adjacent fan blades to permit air flow in the radial direction. The curved strips cooperate with the hub to form passages which permit air flow in the axial direction, and are shaped as sections of a parabolic surface which opens toward the upstream end of the hub.

3 Claims, 6 Drawing Sheets

FAN CAPABLE OF DIRECTING AIR FLOW IN BOTH AXIAL AND RADIAL DIRECTIONS

BACKGROUND OF THE INVENTION

1. Field of the Invention

The invention relates to a fan construction, more particularly to a fan which is capable of directing air flow in the axial and radial directions and which generates little noise and vibrations when rotated at high speeds.

2. Description of the Related Art

Referring to FIG. 1, a conventional motor 1 is shown to be provided with a fan 12 and includes a motor housing 10, a driving spindle 11, an upstream cover 13, and a downstream cover 14. The fan 12 is mounted securely on the driving spindle 11. The upstream cover 13 is attached to the upstream end 101 of the motor housing 10, while the downstream cover 14 is attached to the downstream end 102 of the motor housing 10. When the motor 1 is activated, the driving spindle 11 rotates the fan 12, thereby causing air to be drawn into the motor housing 10 via the downstream cover 14 in order to cool the motor 1. Hot air flows out of the motor housing 10 via the upstream cover 13.

The fan 12 determines the direction of air flow through the motor housing 10. Presently, there are two different kinds of fan constructions. The first kind directs air to flow in an axial direction, while the second kind directs air to flow in a radial direction.

FIG. 2 is a sectional view which illustrates a conventional motor 2 that employs an axial flow-type fan 21. When the motor 2 is activated, the fan 21 draws air into the motor housing 20 via an air inlet portion 22 at the downstream end of the latter. The fan 21 directs air to flow out of the motor housing 20 via an air outlet portion 23 at the upstream end of the latter.

Aside from the difference in the constructions of the axial flow-type fan and the radial flow-type fan, the construction of the motor housing for the radial flow-type fan is slightly different from that for the axial flow-type fan. When air that is drawn by the radial flow-type fan strikes the fan blades of the latter, the air is dispersed in the radial direction. Air then flows out of the motor housing via air outlet holes that are located around the fan.

Since conventional fans are incapable of directing air flow in both axial and radial directions, the stability of the conventional fans in the axial and radial directions cannot be ensured, thereby resulting in strong vibrations and in the generation of relatively loud noise when the conventional fans are in use.

SUMMARY OF THE INVENTION

Therefore, the objective of the present invention is to provide a fan which is capable of directing air flow in the axial and radial directions, thus resulting in little vibration and in little noise when the fan rotates at high speeds.

Accordingly, the fan of the present invention is capable of directing air passing between upstream and downstream ends of the fan to flow in both axial and radial directions and includes a hub, a plurality of fan blades and a ring. The hub is shaped as a truncated cone with a wide upstream end and a narrow downstream end. Each of the fan blades has an upstream edge, an outer end and an inner end connected to the hub. The fan blades project radially and outwardly from the hub and are spaced circumferentially. The ring is disposed at the upstream edges of the fan blades and interconnects the outer ends of the latter. The ring is formed with a plurality of curved strips which extend respectively between two adjacent fan blades to permit air flow in the radial direction. The curved strips cooperate with the hub to form passages which permit air flow in the axial direction, and are shaped as sections of a parabolic surface which opens toward the upstream end of the hub.

BRIEF DESCRIPTION OF THE DRAWINGS

Other features and advantages of the present invention will become apparent in the following detailed description of the preferred embodiment, with reference to the accompanying drawings, of which.

DETAILED DESCRIPTION OF THE PREFERRED EMBODIMENT

Figure 1:
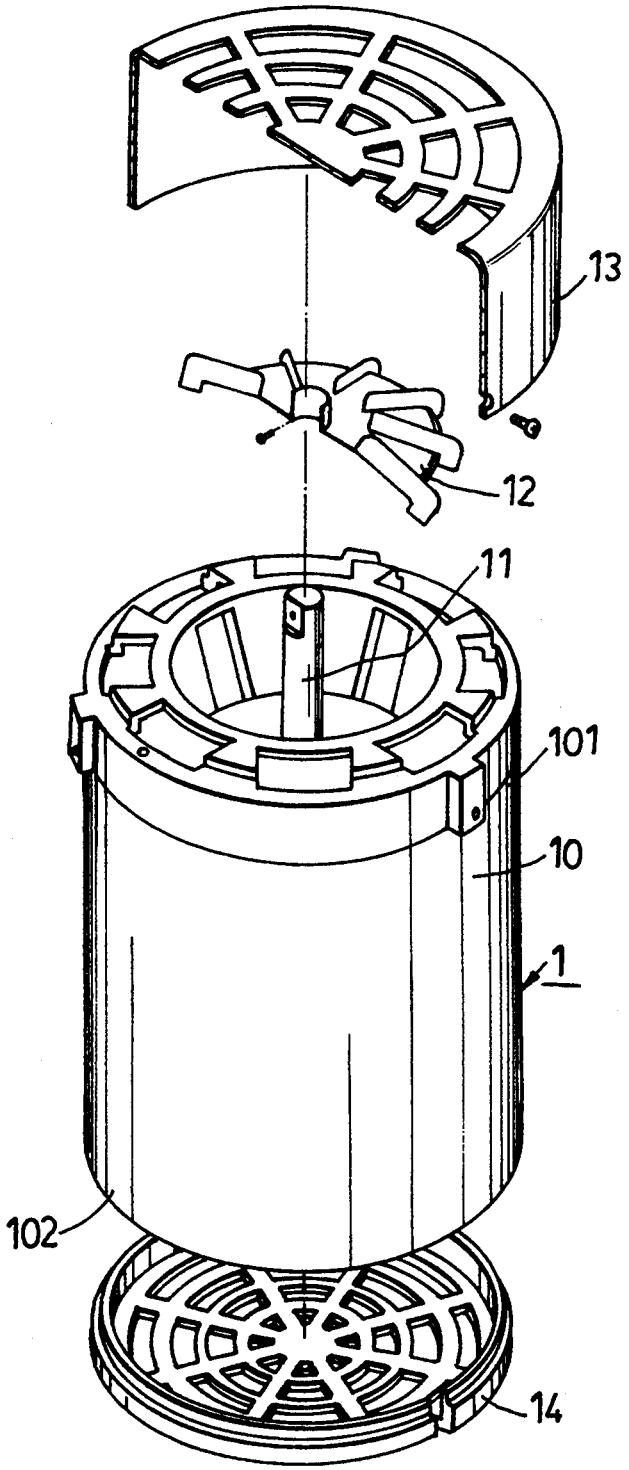
FIG.1 PRIOR ART
FIG. 1 is a partly exploded, perspective view of a conventional motor which is provided with a fan.
Figure 2:
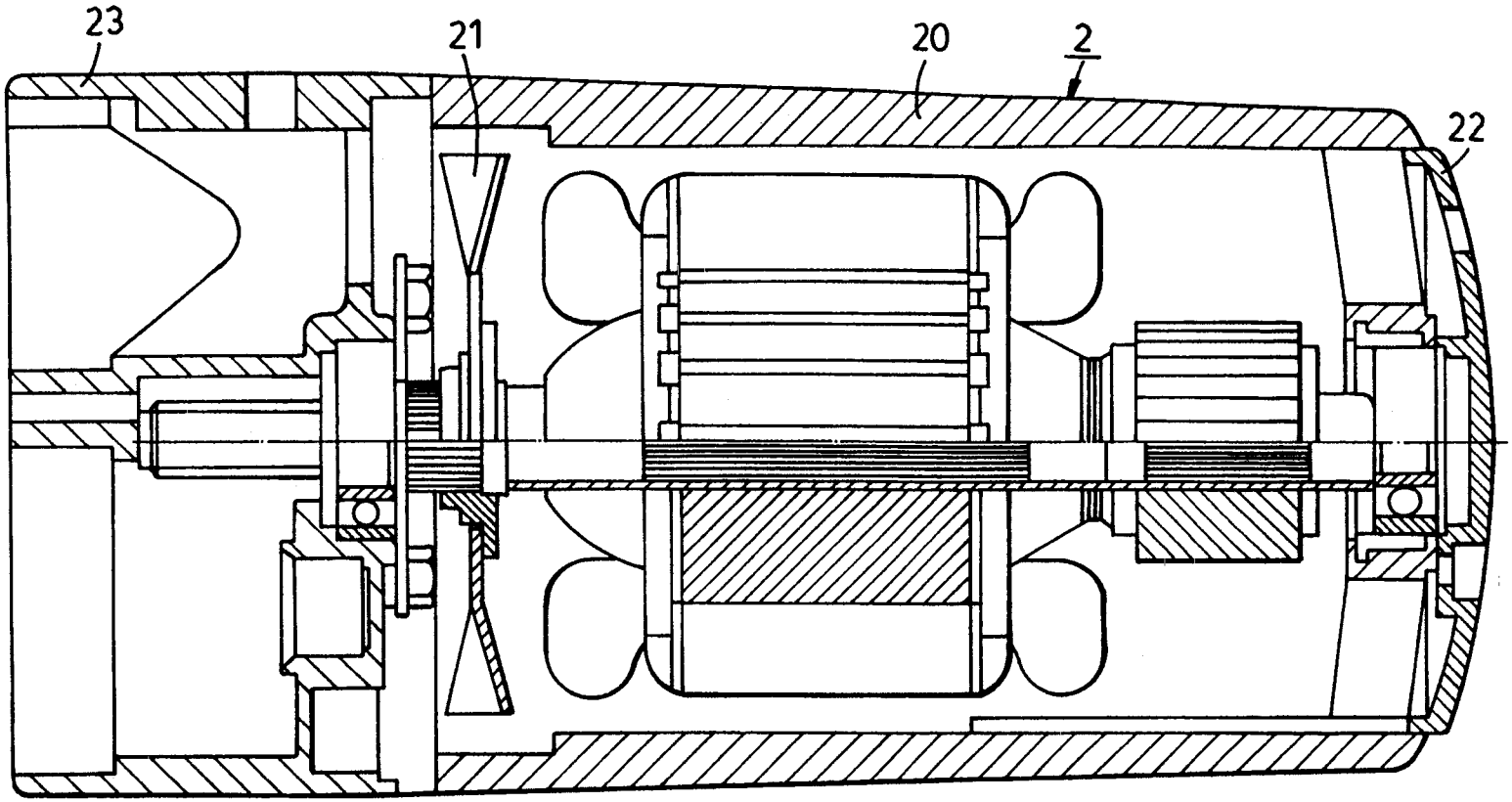
FIG. 2 PRIOR ART
FIG. 2 is a schematic sectional view of a conventional motor which is provided with an axial flow-type fan.
Figure 3:
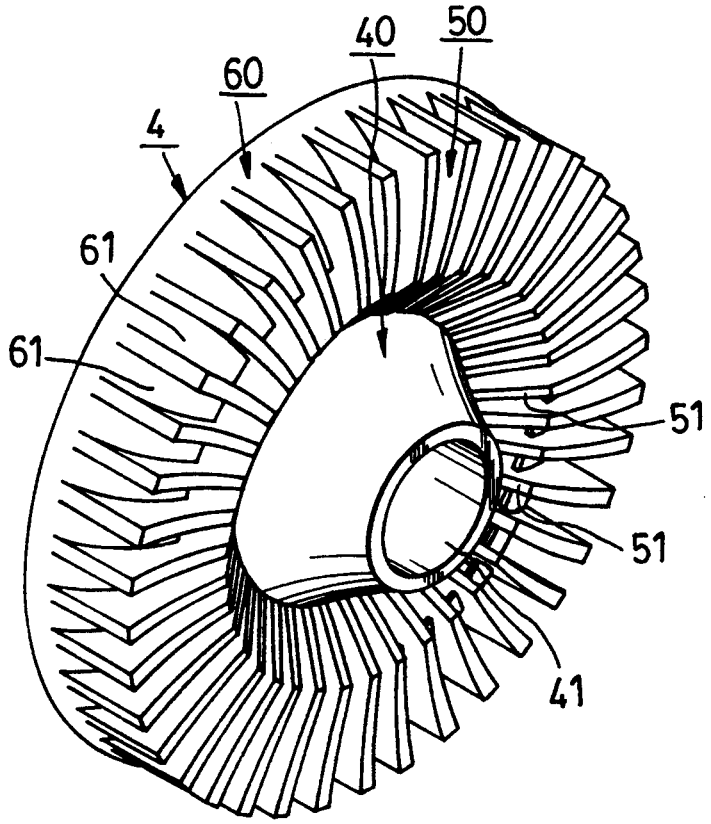
FIG. 3 is a downstream perspective view of the preferred embodiment of a bidirectional flow-type fan according to the present invention.
Figure 4:
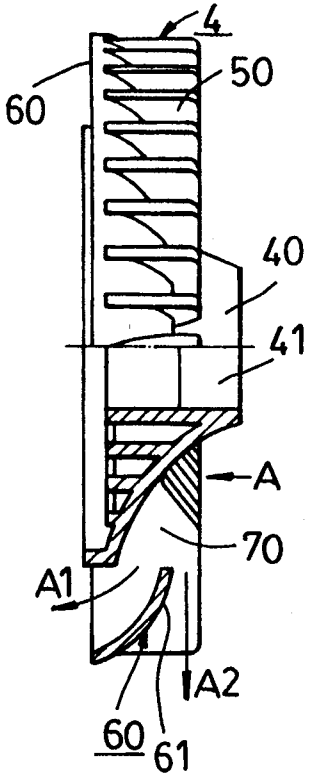
FIG. 4 is a schematic side view of the preferred embodiment.

Referring to FIGS. 3 and 4, the preferred embodiment of a fan 4 according to the present invention is shown to comprise a hub 40, a plurality of fan blades 50 and a ring 60.

Figure 6:
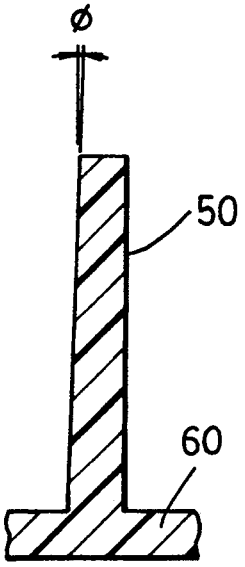
FIG. 6 is a sectional view of a fan blade of the preferred embodiment.
Figure 7:
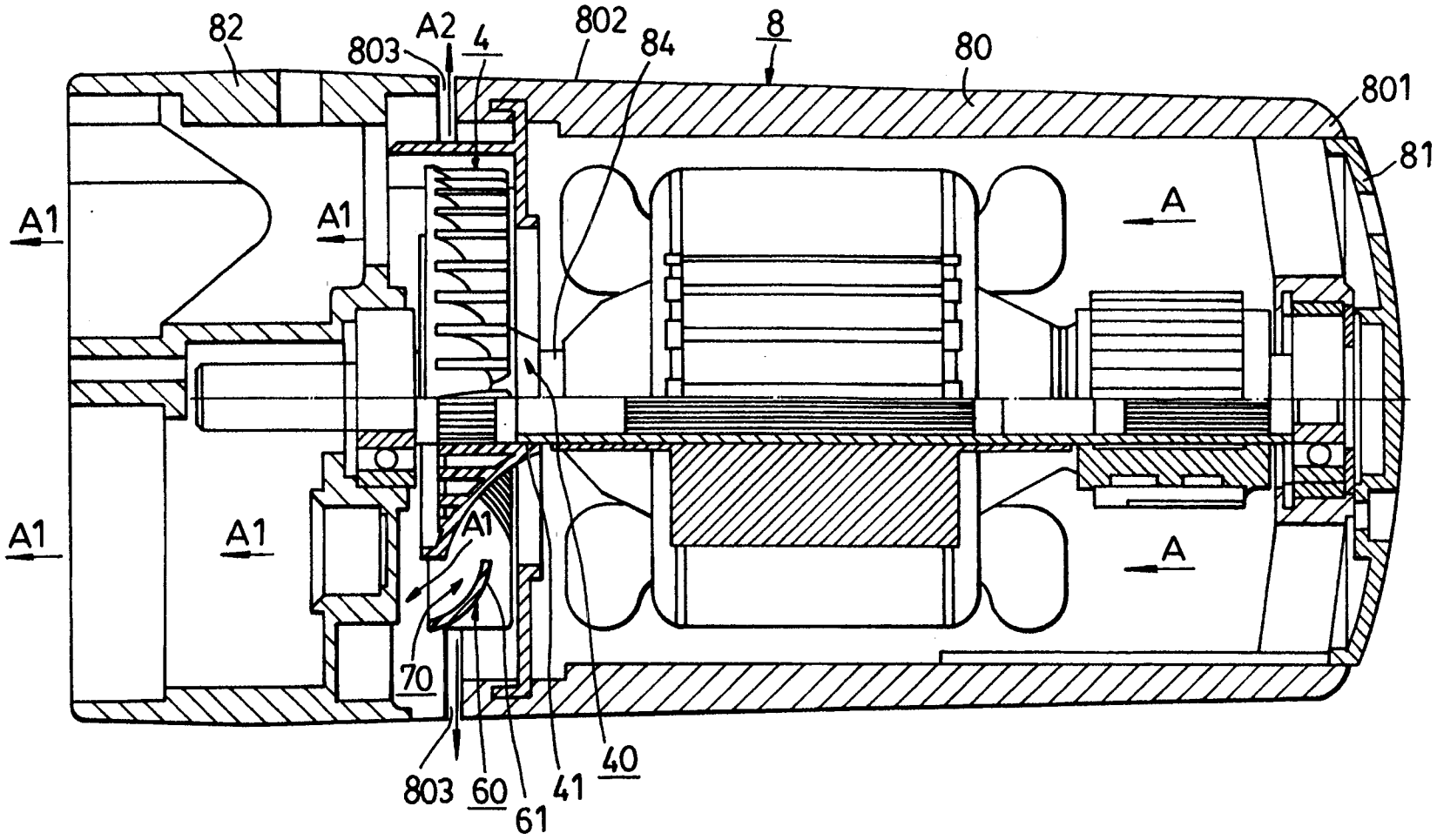
FIG. 7 is a schematic sectional view of a motor which is provided with the fan of the present invention.

The hub 40 is shaped as a truncated cone with a wide upstream end and a narrow downstream end. The hub 40 confines a through-hole 41 and is adapted to be secured on the driving spindle 84 of a motor 8, as shown in FIG. 7. Each of the fan blades 50 has a tapered inner end 51 which is connected to the hub 40. The fan blades 50 project radially and outwardly from the hub 40 and are spaced circumferentially. In this embodiment, there are thirty-nine fan blades 50. Thus, adjacent fan blades 50 are spaced by an angle of approximately 9.23°. The fan blades 50 curve slightly in one direction. In this embodiment, the fan blades 50 curve slightly in the counterclockwise direction. The fan blades 50 further have side wall surfaces which form a draft ($\phi$) of about 1°, as shown in FIG. 6.

The ring 60 is disposed at the upstream edges of the fan blades 50 and interconnects the fan blades 50 at the outer ends of the latter. The ring 60 is formed with a plurality of curved strips 61 which extend respectively between two adjacent fan blades 50. The curved strips 61 cooperate with the hub 40 to form a plurality of passages 70. In this embodiment, the curved strips 61 are shaped as sections of a parabolic surface which opens toward the upstream end of the hub 40.

Figure 5:
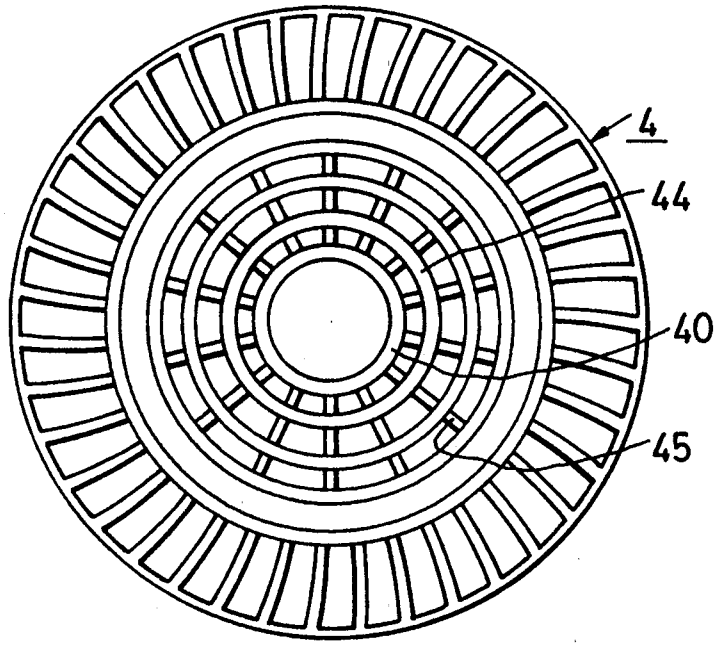
FIG. 5 is a schematic upstream view of the preferred embodiment.

Referring to FIG. 5, the upstream end of the hub 40 is formed with a plurality of concentric reinforcing rings 44 and a plurality of radial reinforcing ribs 45 which interconnect the reinforcing rings 44, thus strengthening the fan 4 of the present invention.

Referring to FIG. 7, a motor 8, which is provided with the fan 4 of the present invention, is shown to comprise a motor housing 80, a downstream cover 81 provided on a downstream end 801 of the motor housing 80, an upstream cover 82 provided on an upstream end 802 of the motor housing 80 and a driving spindle 84 which extends through the through-hole 41 confined by the hub 40 of the fan 4. The motor housing 80 is formed with a plurality of air outlet holes 803 which are located around the fan 4 in order to permit air to flow out of the motor housing 80 in the radial direction.

Referring to FIGS. 4 and 7, when the motor 8 is activated, the driving spindle 84 rotates to rotate the fan 4 therewith, thereby causing a volume of air (A) to be drawn into the motor housing 80. When the air (A) reaches the fan 4, a portion (A1) of the air (A) flows through the passages 70, thereby resulting in an axial air flow which flows out of the motor housing 80 via the upstream cover 82. Note that the fan blades 50 provide minimal resistance to air flow through the passages 70 because the fan blades 50 are connected to the hub 40 at the tapered inner ends 51 of the former. The remaining portion (A2) of the air (A) impacts the curved strips 61, thereby resulting in a radial air flow which flows out of the motor housing 80 via the air outlet holes 803 around the fan 4.

Since the fan of the present invention is capable of directing air passing between upstream and downstream ends thereof to flow in both axial and radial directions, the fan is stable in both directions. Therefore, the vibrations of a motor which employs the fan of the present invention can be effectively reduced to minimize correspondingly the noise that is generated. The objective of the present invention is thus achieved.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A fan capable of directing air passing between upstream and downstream ends of said fan to flow in both axial and radial directions, said fan comprising:

a hub shaped as a truncated cone with a wide upstream end and a narrow downstream end;

a plurality of fan blades, each of which having an upstream edge, an outer end and an inner end connected to said hub, said fan blades projecting radially and outwardly from said hub and being spaced circumferentially; and a ring which is disposed at said upstream edges of said fan blades and which interconnects said outer ends of said fan blades, said ring being formed with a plurality of curved strips which extend respectively between two adjacent said fan blades to permit air flow in the radial direction, said curved strips cooperating with said hub to form passages which permit air flow in the axial direction, said curved strips being shaped as sections of a parabolic surface which opens toward said upstream end of said hub.

2. The fan as claimed in claim 1, wherein said fan blades curve slightly in one direction.

3. The fan as claimed in claim 1, wherein each of said fan blades has opposite side wall surfaces which form a draft of about 1°.

* * * * *